US007296522B1

(12) United States Patent
Mahmalji

(10) Patent No.: US 7,296,522 B1
(45) Date of Patent: Nov. 20, 2007

(54) PATIO HEATER TABLE

(76) Inventor: Alan J. Mahmalji, 15631 Irene Way, Westminster, CA (US) 92683

( * ) Notice: Subject to any disclaimer, the term of this patent is extended or adjusted under 35 U.S.C. 154(b) by 286 days.

(21) Appl. No.: 11/159,464

(22) Filed: Jun. 23, 2005

(51) Int. Cl.
*A47B 37/00* (2006.01)
*A47B 57/00* (2006.01)

(52) U.S. Cl. ..... 108/50.13; 108/64

(58) Field of Classification Search ..... 108/50.13, 108/50.12, 64, 27, 184, 183; 211/126.8, 211/126.9, 133.2, 133.5
See application file for complete search history.

(56) References Cited

U.S. PATENT DOCUMENTS

| | | | | | |
|---|---|---|---|---|---|
| 1,320,215 | A * | 10/1919 | Field | 108/64 |
| 1,890,409 | A * | 12/1932 | Roberts | 108/35 |
| 2,782,085 | A * | 2/1957 | Natale | 108/94 |
| 4,003,320 | A * | 1/1977 | Owens et al. | 108/158 |
| 5,322,023 | A | 6/1994 | Hammond | |
| 5,522,514 | A * | 6/1996 | Robinson | 211/188 |
| 6,017,188 | A | 1/2000 | Benton | |
| 6,192,878 | B1 | 2/2001 | Waters | |
| 6,347,591 | B1 * | 2/2002 | Karpa et al. | 108/50.11 |
| D456,498 | S | 4/2002 | Jeng | |
| D462,427 | S | 9/2002 | Jeng | |
| D462,854 | S * | 9/2002 | Corning et al. | D6/480 |
| 6,688,239 | B1 * | 2/2004 | Pettini et al. | 108/50.11 |
| 6,698,363 | B2 * | 3/2004 | Mallon | 108/83 |
| 6,907,875 | B1 * | 6/2005 | Eastman, II et al. | 126/92 B |
| 2004/0226487 | A1 * | 11/2004 | Yang | 108/50.12 |
| 2005/0109247 | A1 | 5/2005 | Nelson et al. | |
| 2006/0196396 | A1 * | 9/2006 | Rivera et al. | 108/157.1 |
| 2007/0041179 | A1 * | 2/2007 | Barthelmess | 362/123 |

* cited by examiner

*Primary Examiner*—Janet M. Wilkens
*Assistant Examiner*—Timothy M Ayres
(74) *Attorney, Agent, or Firm*—Gordon K. Anderson

(57) ABSTRACT

A patio heater table (10) for encompassing a patio heater (14) consists of a duplicate pair of table sides (20) having a table upper portion with legs (46) that are connected by a permanent brace ring segment (52). The table upper portion is formed with a semi-circular structure (22) made of a peripheral ring (24) and a bisecting chord (28) having a midpoint radial concave portion (30) for avoiding contact with the heater standard, or post, (12). The two table sides mate together and are attached with each side positioned over and around the patio heater. The table includes removable brace ring segments (54) that are attached to the leg permanent brace ring segments providing access to the patio heater for fuel replacement. The table is made of steel or aluminum material and is preferably of welded construction.

18 Claims, 6 Drawing Sheets

PATIO HEATER TABLE

TECHNICAL FIELD

The present invention relates to outdoor tables in general. More specifically to an outdoor patio table that encompasses a patio heater.

BACKGROUND ART

Previously, many types of outdoor tables have been used to provide an effective means to place dining items and foodstuffs and other useful articles in a convenient location near or around a patio heater or patio umbrella for outdoor use.

The prior art listed below did not disclose patents that possess any of the novelty of the instant invention; however the following U.S. patents are considered related:

| | Inventor | Issue Date |
|---|---|---|
| U.S. Pat. No. | | |
| 5,322,023 | Hammond | Jun. 21, 1994 |
| 6,017,188 | Benton | Jan. 25, 2000 |
| 6,192,878 | Waters | Feb. 27, 2001 |
| D456,498 | Jeng | Apr. 30, 2002 |
| D462,427 | Jeng | Sep. 3, 2002 |
| Patent Application Publication | | |
| US2005/0109247 | Nelson et al. | May 26, 2005 |

Hammond in U.S. Pat. No. 5,322,023 teaches a service tray for use on a table with an umbrella pole in the center. The tray defines a slot and closure member for mounting to the tray around the pole with the closure member covering the slot. The connection of the closure member to the tray is readily released allowing the slot of the tray to be open permitting insertion around or removal from around the pole. The tray includes a number of compartments for receiving food, with rollers positioned on the underside to facilitate rotation of the tray on its supporting surface.

U.S. Pat. No. 6,017,188 issued to Benton is for a combination patio table and pole fan. The invention utilizes a fan mounted on a pole that passes through the center of the patio table. The pole also supports an umbrella that can be used for shade when the table is located outside. The central pole for the device comes in three pieces to vacillate shipping and assembly.

Waters in U.S. Pat. No. 6,192,878 discloses a heating apparatus that includes a perforated wall burner assembly housing containing a burner for igniting fuel from a fuel source. One improvement to the heating apparatus is the provision of a table that has a central opening for receipt of the pole or standard with the table top positioned above the heater base. Foldable legs of the table are pivoted out from under the table top to provide the table with stability when in use. The size of the legs may be coordinated with that of the base so that the table top is closely adjacent or in engagement with the top of the base. Alternatively the legs may be omitted from the table with the entire weight of the table top resting upon the base.

Jeng in U.S. design patent D456,498 presents the ornamental design of a combined gas heater and table with four legs mounted under the table for support. The table top is illustrated with perforations having a diamond shape.

U.S. design patent D462,427 also issued to Jeng is for the ornamental design of a combined gas heater and table with the table top resting directly on the heater base for support. The table top is illustrated having a solid top with the upper portion of the base protruding slightly above the top in the center.

Patent Application Publication No. US2005/0109247 of Nelson et al. discloses a rotatable tray mounted to a vertical pole having a truncated conical shape support sleeve attached thereto. The tray has a beveled bore in a truncate conical shaped inclining upwardly and outwardly to interface with the sleeve. An O-ring fits over the support sleeve and the pole fits into a hole in the center of the table top and is supported by a base.

DISCLOSURE OF THE INVENTION

Outdoor patios, yards, porches and courts are popular areas to enjoy the outdoors in pleasant weather and often meals are taken in these locales requiring tables and chairs. In cooler climates the season for this type of enjoyment is often extended by the use of patio heaters that usually operate using bottled liquefied gas and produce sufficient heat to make it comfortable enough to pursue this type of activity. It is desirable to be located close enough to the heater to gain the needed benefit requiring tables to be closely positioned to the heat source. Since conventional outdoor type patio tables are usually round and many have umbrellas protruding from the middle it is difficult to place the table close enough to the heater to gain the same advantage to all sitting around the table.

The requirement has existed to solve this long felt need therefore it is the primary object of the invention to provide a table that is easily assembled around the heater affording convenience and equal warmth without loosing valuable space on the table. The invention is made with two identical table halves that are placed one on each side of the heater and are aligned with a dowel pin and connected with threaded fasteners. A removable brace ring segment is attached in a similar manner on each side providing strength and rigidity to the legs.

An important object of the invention is the ease of assembly since it consists of two separate but identical table sides that require only positioning together and connecting two wing nuts on each side. The two removable brace ring segments have slots on each end that are aligned with threaded studs furnished with wing nuts. The removable segments impart another object of the invention which presents the necessary utility of removing one of the segments to replace the fuel tank housed in the heater base.

Still another object of the invention is in the design which makes it easy to manufacture as there are two duplicate halves and duplicate brace ring segments permitting the same tooling and manufacturing procedures to be used which achieves economies of number reducing the final cost of manufacture to be well within the reach of the masses.

Yet another object of the invention is its ease of storage because a conventional patio table is made in one piece and requires considerable storage space. Since the invention is made in two sections it actually cuts the envelope size in half reducing the space by 50 percent of a normal outdoor table since the sections may be stacked in reverse and nested together.

A further object of the invention it in the fact that it is made of fireproof metal which is safe to be employed next to the heater and furthermore the construction is solid and robust as it is basically produced as a weldment.

A final object of the invention is the feature that adjusts the table height to correspond with almost any heater available on today's market. The adjustment also permits the table to be leveled on uneven patio surfaces particularly flagstone and other similar surfaces.

While the invention is primarily designed as a patio heater table the utility may be equally utilized as a table having an umbrella mounted in the middle which is easily substituted and works just as well. This dual function is important as the table may be used in the summer when it is hot and shade is the favored commodity as an umbrella table and when it turns cold as a heater table.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
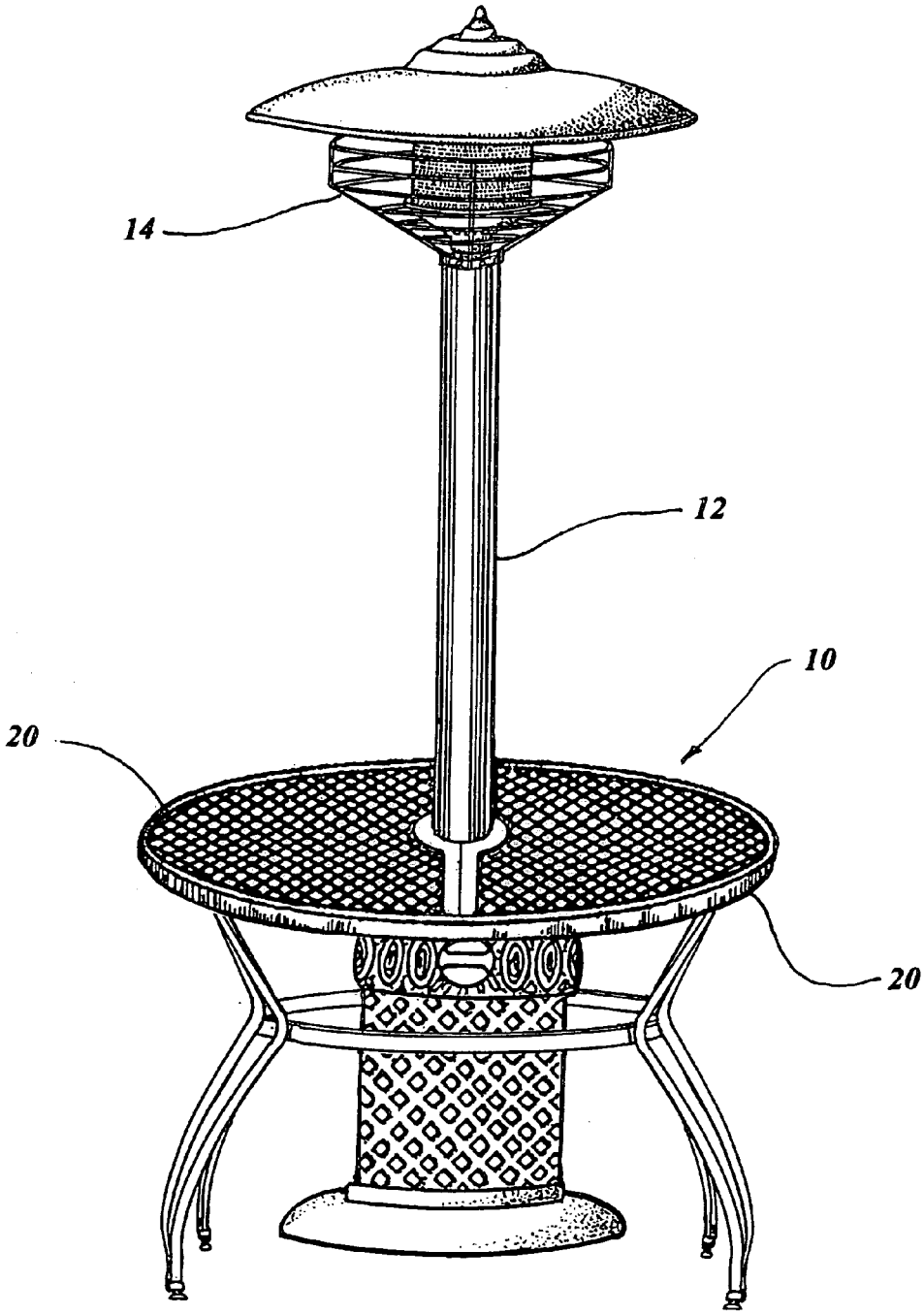
FIG. 1 is a partial isometric view of the patio heater table in the preferred embodiment showing the table installed around a representative style heater.
Figure 2:
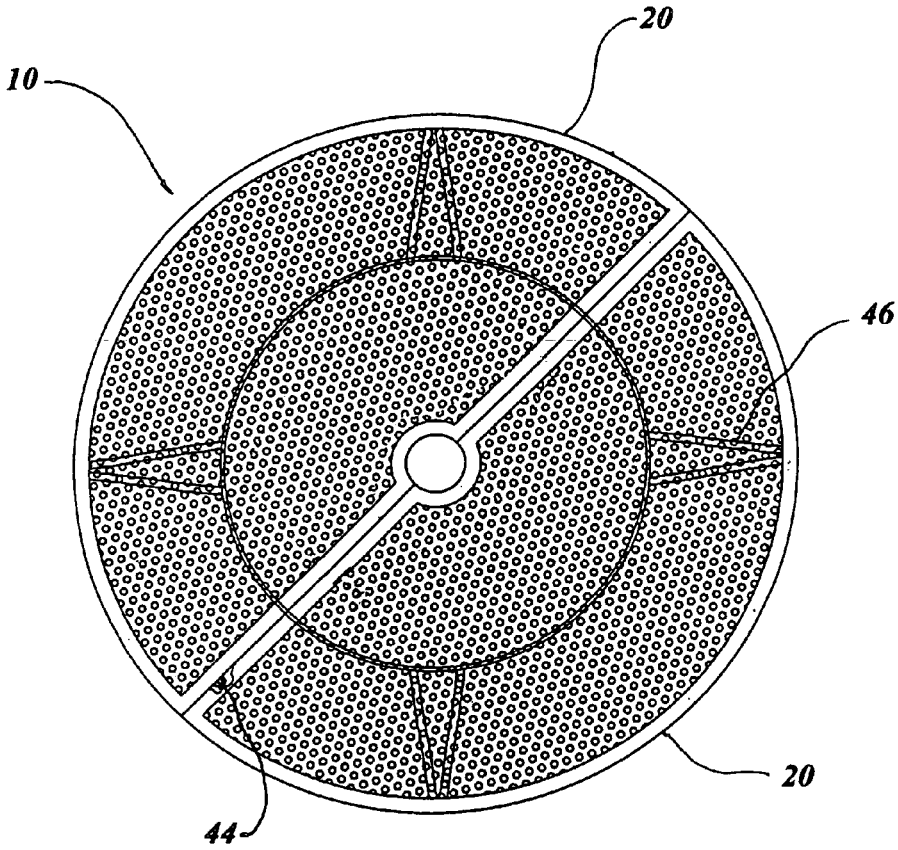
FIG. 2 is top view of the patio heater table with both halves connected together in the preferred embodiment.
Figure 3:
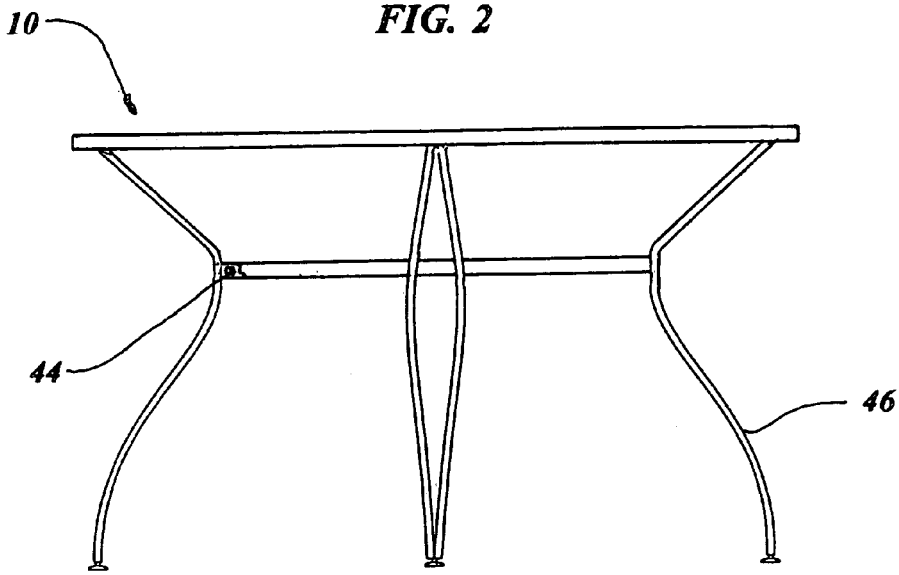
FIG. 3 is front elevation view of the patio heater table with both halves connected together in the preferred embodiment.
Figure 4:
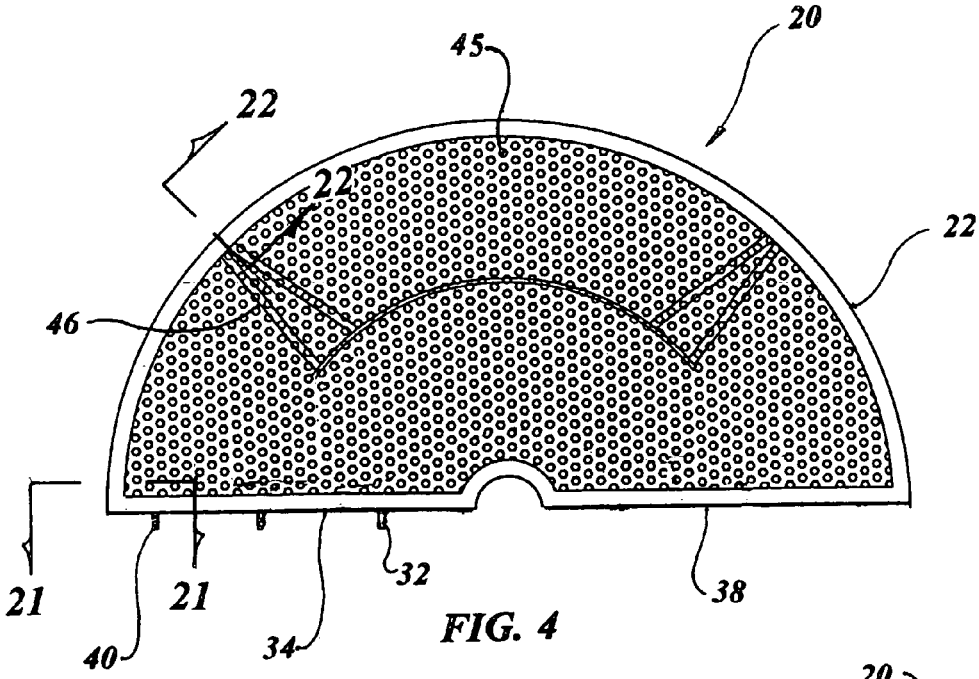
FIG. 4 is a top view of the patio heater table half in its preferred embodiment.
Figure 5:
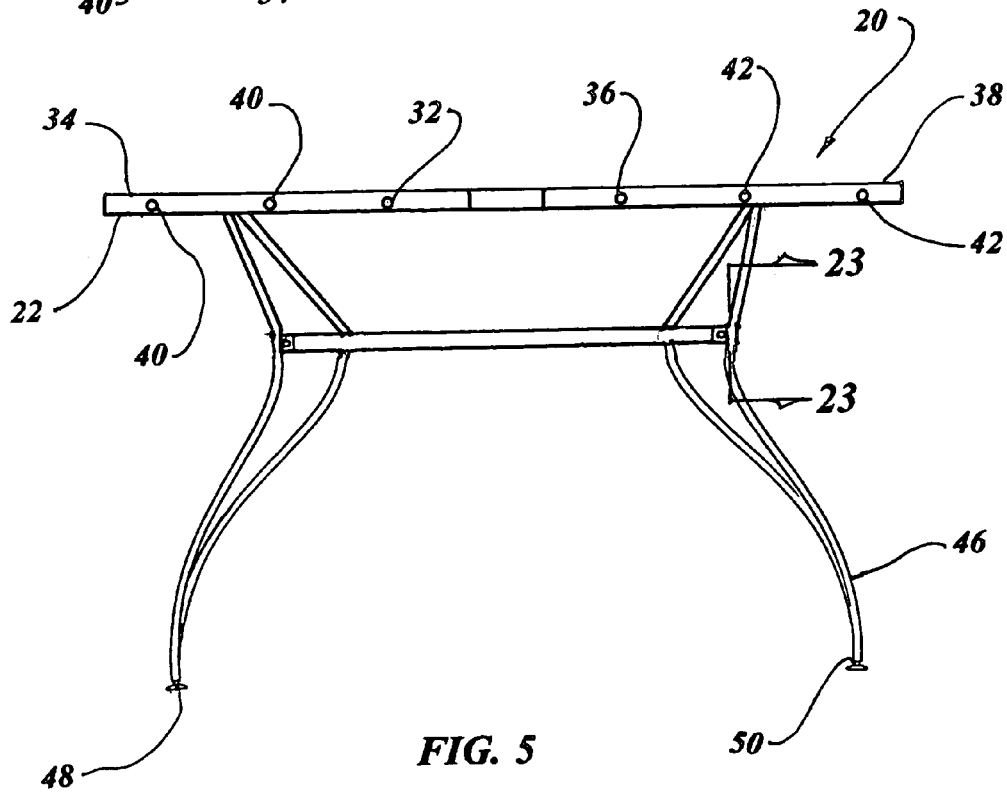
FIG. 5 is a front elevation view of the patio heater table half in its preferred embodiment.
Figure 6:
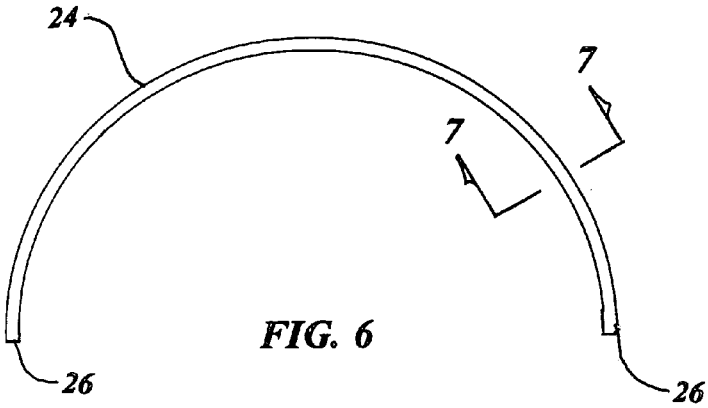
FIG. 6 is a top view of one of the semi-circular peripheral rings of the invention shown removed a semi-circular structure for clarity.
Figure 7:
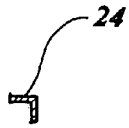
FIG. 7 is a cross sectional view taken along lines 7-7 of FIG. 6.

The best mode for carrying out the invention is presented in terms of a preferred embodiment of the patio heater table 10 that is designed to encompass the standard 12 or post of a patio heater 14. This preferred embodiment is illustrated in FIGS. 1 thorough 28 and is comprised of a duplicate pair of table sides 20 with the table 10 illustrated with the sides 20 attached together in FIGS. 1-3 and one of the sides illustrated solitarily in FIGS. 4 and 5. The table sides 20 each consist of a semi-circular structure 22 made from a weldment utilizing a peripheral ring 24 having distal ends 26 made of structural material, preferably in the form of a metal angle, and a similar bisecting chord 28. The table side 20 is completed by the addition of a table top, legs and a brace ring that will be described later.

Figure 8:
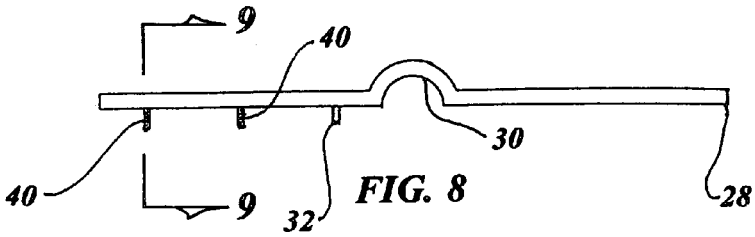
FIG. 8 is a top view of one of the bisecting chords of the invention shown removed from a semi-circular structure for clarity.
Figure 9:
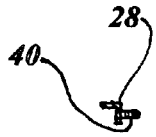
FIG. 9 is a cross sectional view taken along lines 9-9 of FIG. 8.
Figure 10:
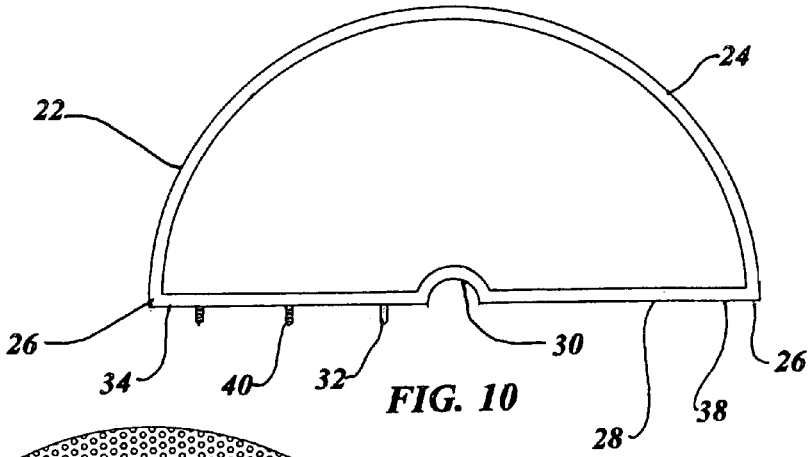
FIG. 10 is a top view of one of the semi-circular structures of the invention shown removed from a table side for clarity.
Figure 11:
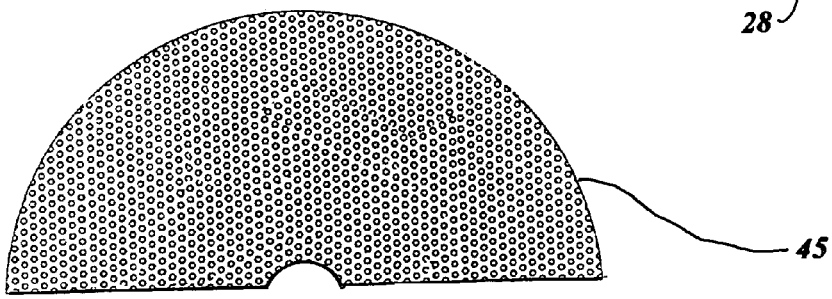
FIG. 11 is a top view of the table top of the invention shown removed for clarity from a one of the semi-circular structures that form part of a table side.
Figure 12:
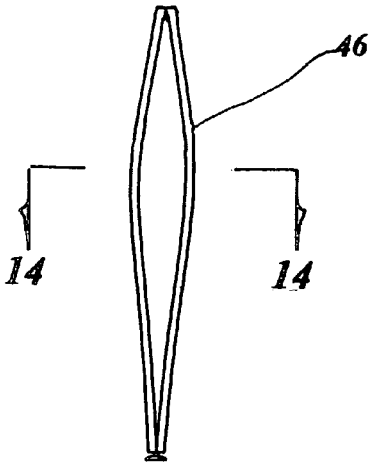
FIG. 12 is a front view of one of the legs of the preferred embodiment.
Figure 13:
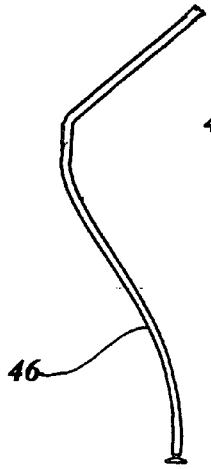
FIG. 13 is a side view of one of the legs of the preferred embodiment.
Figure 14:
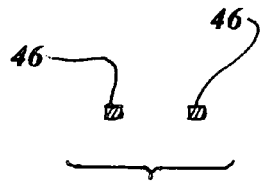
FIG. 14 is a cross sectional view taken along lines 14-14 of FIG. 12.

The bisecting chord 28 of the semi-circular structure 22 includes a midpoint radial concave portion 30, as shown best in FIGS. 2, 4, 8 and 10, and is permanently attached by welding to the peripheral ring 24 on each distal end 26 forming the ring and chord into the semi-circular structure 22, as illustrated in FIG. 10. The bisecting chord 28, illustrated in FIGS. 8 and 9 is made of the same structural material, in a metal angular form, as the peripheral ring 24. The material for the semi-circular structure 22 is formed from a material such as steel, aluminum or wrought iron.

The bisecting chord 28 includes means for alignment of the duplicate pair of table sides 20 in the form of an alignment pin 32 on a first half 34 of the vertical angular face of the bisecting chord 28 and mating bore 36 located on a second half 38 of the vertical angular face of the bisecting chord 28 in reverse duplication. When the table sides 20 are mated together the alignment pin 32 penetrates the mating bore 36 thereby providing the exact placement of the table sides 20. The pins 32 and bores 36 are illustrated best in FIG. 5 with the pins 32 also depicted in FIGS. 4, 8 and 10.

The bisecting chord 28 also includes means for fastening the duplicate pair of table sides 20 together in the form of a plurality of threaded studs 40 on the first half 34 vertical angular face of the bisecting chord 28. A plurality of mating clearance holes 42 are located in the second half 38 of the vertical angular face of the bisecting chord 28 in reverse duplication. When the table sides 20 are mated together the threaded studs 40 penetrate the mating clearance holes 42 and a plurality of nuts 44, preferably the winged type, are threaded onto the studs 40 providing removable attachment of the table sides 20 together. The threaded studs 40 and clearance holes 42 are illustrated best in FIG. 5 with the threaded studs 40 also depicted in FIGS. 4 and 8-10.

Figure 21:
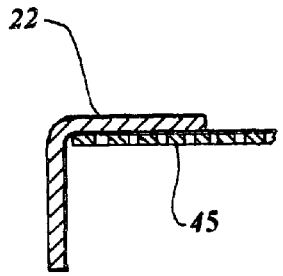
FIG. 21 is a cross sectional view taken along lines 21-21 of FIG. 4.

The table top 45 is preferably made from perforated metal of steel or aluminum that is permanently attached to the semi-circular structure 22 by spot welding or the like. While perforated metal is prefer other materials such as solid metal sheet, flattened expanded metal or decorative stamped sheet metal may be substituted with ease. In any case the raw edges of the table top 45 are hidden under the formed leg of the semi-circular structure 22, as illustrated in FIG. 21. It is anticipated that the table top material has sufficient structural integrity to remain rigid enough to hold heavy objects without sagging or if thinner material is used reinforcing may be required in the form of structural members and or in conjunction with braces.

Figure 22:
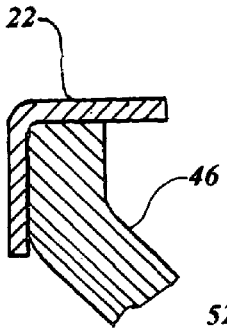
FIG. 22 is a cross sectional view taken along lines 22-22 of FIG. 4.
Figure 23:
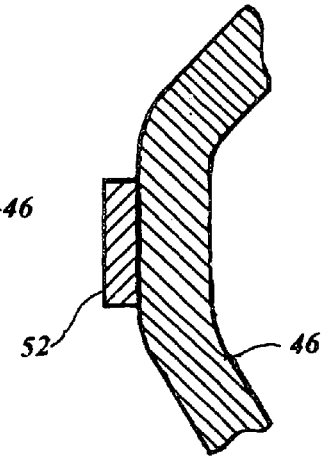
FIG. 23 is a cross sectional view taken along lines 23-23 of FIG. 5.
Figure 24:
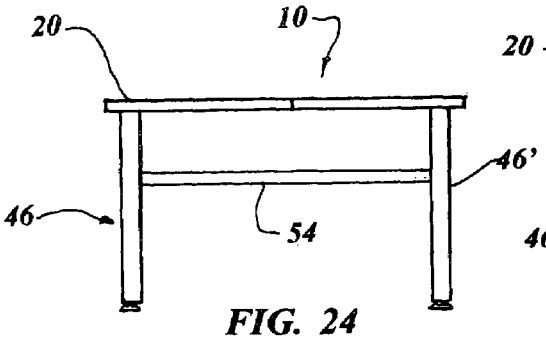
FIG. 24 is a side elevation view of an optional embodiment of the patio heater table with at least two straight legs.
Figure 25:
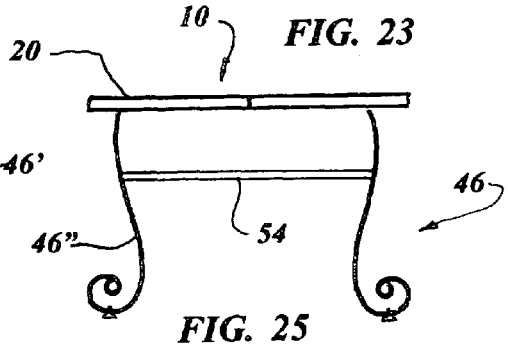
FIG. 25 is a side elevation view of an optional embodiment of the patio heater table with at least two radially curved legs.

A plurality of legs 46 are attached to the peripheral ring 24 of the semi circular structure 22, as shown in FIG. 22, and distend downwardly therefrom for supporting the table 10. The legs 46 may be in a myriad of shapes and styles such as at least two discrete legs 46 or double legs 46 on each table side 20 with the drawings depicting double legs 46 consisting of mated pairs having an ornamental design shape as shown in FIGS. 1-5, 12 and 13. FIG. 24 illustrates another leg configuration having two straight legs 46' on each table side 20 and FIG. 25 shows radially curved legs 46" as another option.

In any case the plurality of legs 46 preferably include means for adjusting height and or leveling of the table 10 in the form of leveling screws 48 with sockets 50 that are well known in the art and readily available. The material for the legs 46 is preferably metal either solid or hollow formed of wrought iron, steel or aluminum.

A permanent brace ring segment 52 is attached between each leg 46 forming a rigid structure when the pair of table sides 20 are mated and attached together with the radial concave portion 30 of the bisecting chord 28 distancing the semi-circular structure 22 from the patio heater standard 12. A matching pair of removable brace ring segments 54 are attached to each end of the permanent brace ring segments 52 forming a structural circumferential ring securing the legs 46 of both table sides 20 together in a rigid manner. The removable brace ring segments 54 are attached to each end of the permanent brace ring segments 52 with detachable means defined as threaded studs 40 fastened to flanged ends of the permanent brace ring segments 52 and mating flanged ends of the removable brace ring segments 54 having slots 56 with nuts 44, preferably the winged type.

While the detachable means for connecting the ring segments 52 and 54 are preferably threaded studs 40 fastened with wing nuts 44, quarter turn fasteners, capscrews and mating wing nuts, capscrews and hex nuts, or over center clamps may be easily substituted and accomplish the same utility. The optional connecting means described above are not shown in the drawings as they are all well known in the art and are off-the-shelf in wide distribution throughout this country.

Figure 15:
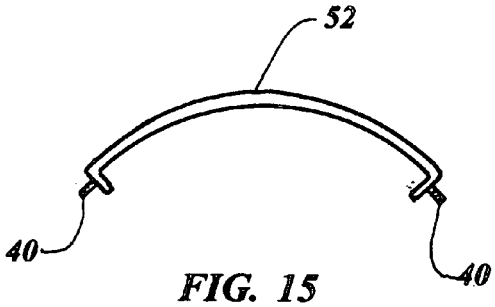
FIG. 15 is a top view of one of the permanent brace ring segments of the preferred embodiment, shown removed from a table side for clarity.
Figure 16:
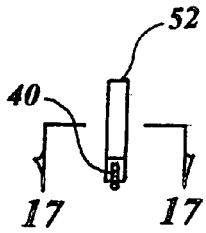
FIG. 16 is a side view of one of the permanent brace ring segments of the preferred embodiment shown removed from a table side for clarity.
Figure 17:
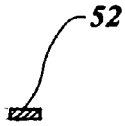
FIG. 17 is a cross sectional view taken along lines 17-17 of FIG. 16.
Figure 19:
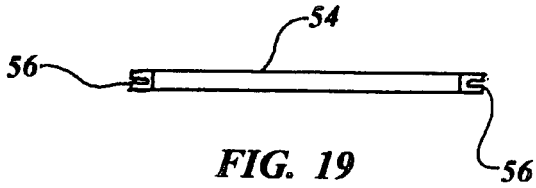
FIG. 19 is a view taken along lines 19-19 of FIG. 18.
Figure 18:
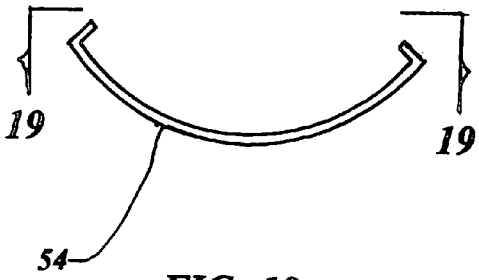
FIG. 18 is a top view of one of the removable brace ring segments of the preferred embodiment, shown removed from a table side for clarity.
Figure 20:
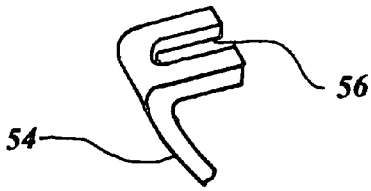
FIG. 20 is partial isometric view of one of the ends of a removable brace ring segment illustrating the slot therein.

The permanent brace ring segment 52 is illustrated in FIGS. 15-17 and the removable brace ring segment 54 in FIGS. 18-20 with FIG. 20 illustrating the slot 56 in greater detail and the studs 40 are illustrated in FIGS. 15 and 16. The permanent brace ring segment 52 and removable brace ring segment 54 are preferably formed from a metal bar of steel or aluminum.

Figure 26:
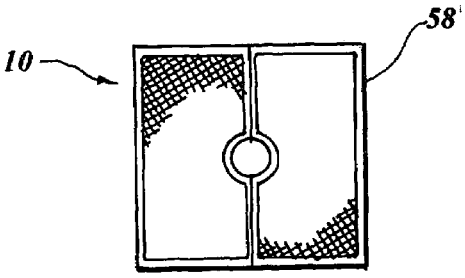
FIG. 26 is a top view of an optional embodiment of the patio heater table with a square table top and accompanying structure.
Figure 27:
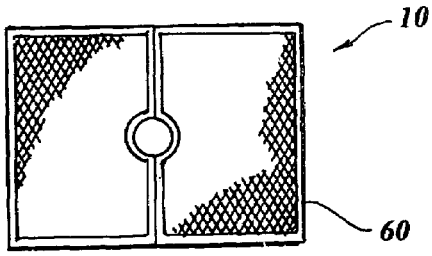
FIG. 27 is a top view of an optional embodiment of the patio heater table with a rectangular shaped table top and accompanying structure.
Figure 28:
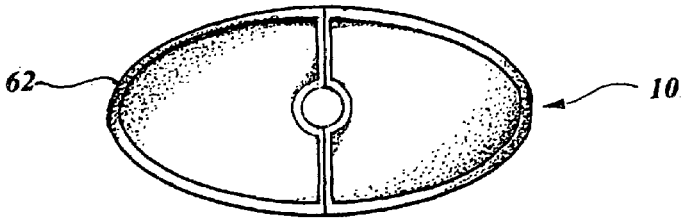
FIG. 28 is a top view of an optional embodiment of the patio heater table with an oval shaped table top and accompanying structure.

The table 10 may have any shape and still be within the scope of the invention even though the drawings depict the round shape. FIGS. 26-28 shows some of the different shapes anticipated such as a square shaped table 58 in FIG. 26 a rectangular table 60 in FIG. 27 and a oval shaped table 62 in FIG. 28. Even the shapes illustrated are not the only configurations applicable as hexagonal, polygonal or irregular shapes are also viable alternatives.

To assemble the patio heater table 10 over a patio heater 14 one of the table sides 20 is placed on one side of the heater 14 and the other side 20 on the opposite aspect with the sides 20 urged together with the alignment pins 32 entering the mating bores 36 while simultaneously the threaded studs 40 enter the clearance holes 42. Wing nuts 44, or like threaded fasteners, are screwed on the studs 40 rigidly securing the table halves together. The removable brace ring segments 54 are then mated with the flanged ends of the permanent brace ring segments 52 with the slots 56 slid onto threaded studs 40 and wing nuts 44 or the like screwed in place. If the fuel in the heater 14 is depleted one of the removable brace ring segments 54 may be detached for convenience While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

The invention claimed is:

1. A patio heater table for encompassing a patio heater standard which comprises, a duplicate pair of table sides each having;

a semi-circular peripheral ring of structural material having distal ends a bisecting chord of structural material having a mid-point radial concave portion, the chord permanently attached to the peripheral ring on each distal end forming the combined ring and chord into a semi-circular structure, a table top permanently attached to the semi-circular structure, a plurality of legs attached to the peripheral ring distending downwardly therefrom for supporting the table, a permanent brace ring segment attached between each leg forming a rigid structure when the pair of table sides are mated together and attached in a removable manner over the patio heater encompassing the heater with the radial concave portion of the chord distancing the semi-circular structure from the patio heater standard, and a matching pair of removable brace ring segments attached to each end of the permanent brace ring segments forming a structural circumferential ring securing the legs of both table sides together in a rigid manner.

2. The patio heater table as recited in claim 1 wherein said a semi-circular peripheral ring of structural material further comprises a metal angle.

3. The patio heater table as recited in claim 1 wherein said bisecting chord of structural material further comprises a metal angle.

4. The patio heater table as recited in claim 1 wherein said bisecting chord of structural material further comprises means for alignment of the duplicate pair of sides together.

5. The patio heater table as recited in claim 4 wherein said means for alignment of the duplicate pair of table sides together further comprises an alignment pin on a first half vertical angular face of said bisecting chord and mating bore on a second half vertical angular face of said bisecting chord in reverse duplication such that when the table sides are mated together the alignment pin penetrates the mating bore providing exact placement of the table sides.

6. The patio heater table as recited in claim 1 wherein said bisecting chord of structural material further comprises means for fastening the duplicate pair of table sides together.

7. The patio heater table as recited in claim 6 wherein said means for fastening the duplicate pair of table sides together further comprises a plurality of threaded studs on a first half vertical angular face of said bisecting chord and a plurality of mating clearance holes on second half vertical angular face of said bisecting chord in reverse duplication such that when the table sides are mated together the threaded studs penetrate the mating clearance holes, further said means for fastening the duplicate pair of table sides together include a plurality of nuts threaded onto the studs providing removable attachment of the table sides together.

8. The patio heater table as recited in claim 1 wherein said table top consists of a material selected from the group consisting of perforated metal, solid metal sheet, flattened expanded metal and decorative stamped sheet metal.

9. The patio heater table as recited in claim 8 wherein said perforated metal, solid metal sheet, flattened expanded metal and decorative stamped sheet metal consists of a base material selected from the group consisting of steel and aluminum.

10. The patio heater table as recited in claim 1 wherein said plurality of legs further comprises at least two discrete legs on each table side.

11. The patio heater table as recited in claim 1 wherein said plurality of legs further comprises at least two double legs on each table side consisting of mated pairs having an ornamental design shape.

12. The patio heater table as recited in claim 1 wherein said plurality of legs further comprises at least two straight legs.

13. The patio heater table as recited in claim 1 wherein said plurality of legs further comprises at least two radially curved legs.

14. The patio heater table as recited in claim 1 wherein said plurality of legs further comprises means for adjusting height and leveling of the table.

15. The patio heater table as recited in claim 1 wherein said permanent brace ring segment and removable brace ring segment further comprises a metal bar.

16. The patio heater table as recited in claim 1 wherein said semi-circular structure, plurality of legs, permanent brace ring segment and removable brace ring segment are formed from a material selected from the group consisting of steel, aluminum and wrought iron.

17. The patio heater table as recited in claim 1 wherein said removable brace ring segments attached to each end of the permanent brace ring segments further comprises detachable means.

18. The patio heater table as recited in claim 17 wherein said detachable means are selected from the group consisting of threaded studs with mating wing nuts, quarter turn fasteners, capscrews and mating wing nuts, capscrews and hex nuts, and over center clamps.

* * * * *